United States Patent [19]

Youngman

[11] Patent Number: 4,781,352

[45] Date of Patent: Nov. 1, 1988

[54] SUPPORT RACK FOR TWEEZERS

[76] Inventor: Rosalie Youngman, 111 Superior, Dover, Ohio 44622

[21] Appl. No.: 138,049

[22] Filed: Dec. 28, 1987

[51] Int. Cl.[4] ..... A47F 5/00

[52] U.S. Cl. ..... 248/309.4; 211/13; 248/205.3; 248/206.5; 248/309.1; 81/3.25

[58] Field of Search ..... 248/309.4, 309.1, 121, 248/201, 206.5, 205.3, 220.2, 221.4, 551, 316.7; 211/69.9, 69.1, 70.6, 13, 83, 84; 81/3.25; 294/99.2; 401/88, 195; D19/81, 82, 83, 89

[56] References Cited

U.S. PATENT DOCUMENTS

| | | | |
|---|---|---|---|
| D. 69,338 | 1/1926 | Weigel | D28/61 |
| D. 131,311 | 2/1942 | Sutton | D28/61 |
| D. 170,669 | 10/1953 | Wagner | D28/61 |
| D. 176,620 | 1/1956 | Lamarthe | D28/61 |
| D. 231,138 | 4/1974 | Ewry | D19/81 X |
| D. 240,537 | 7/1976 | Sronce | D28/61 |
| D. 251,512 | 4/1979 | Freeman | D28/61 |
| 2,297,806 | 10/1942 | Smith | 211/69.1 |
| 2,693,788 | 11/1954 | Spatz | 211/69.1 |
| 3,159,372 | 12/1964 | McIntosh | 248/206.5 X |
| 3,171,176 | 3/1965 | Shirley | 211/69.9 X |
| 3,287,690 | 11/1966 | Book | 248/316.7 X |
| 3,583,263 | 6/1971 | Herigstad | 81/3.25 |
| 4,417,710 | 11/1983 | Adair | 248/205.3 X |
| 4,662,250 | 5/1987 | Kee | 81/3.25 |

FOREIGN PATENT DOCUMENTS

| | | | |
|---|---|---|---|
| 0612067 | 11/1948 | United Kingdom | 248/201 |

*Primary Examiner*—Ramon O. Ramirez
*Attorney, Agent, or Firm*—Jerry T. Kearns

[57] ABSTRACT

A first embodiment of a support rack for tweezers has a circular mounting plate provided with an adhesive backing strip for attaching the mounting plate to a bathroom wall. A pair of parallel spaced elongated bars are centrally disposed on a front surface of the mounting plate. The elongated bars form a channel in which a pair of tweezers are removably retained. A coiled plastic telephone type cord has one end attached to one of the elongated bars and an opposite end attached to the tweezers. The tweezers are thus always readily available for removing the cotton packing from medicine bottles. In a second embodiment of the present invention, a bottle opener for medicine bottles is attached to the tweezer mounting plate. The bottle opener forms a shelf on which a medicine bottle may be stored. Thus, the cotton packing from the medicine bottle may be removed by the tweezers after the cap has been removed using the bottle opener.

8 Claims, 3 Drawing Sheets

SUPPORT RACK FOR TWEEZERS

BACKGROUND OF THE INVENTION

1. Field of the Invention

The present invention relates to support racks, and more particularly pertains to a new and improved tweezer support rack for storing a pair of tweezers in a convenient location so that the tweezers will be readily available for removing the cotton packing from medicine bottles. In a second embodiment, a bottle opener is provided on the tweezer support rack for removing the cap from a medicine bottle. The standard form of medicine bottle is provided with a safety cap which is difficult to remove. Additionally, medicine bottles are typically provided with a cotton packing which must be removed before the contents of the bottle may be utilized. This cotton packing is difficult to remove without the use of tweezers. In order to overcome these problems, the present invention provides a tweezer support rack for maintaining a pair of tweezers in a conveniently accessible location on a bathroom wall. The tweezer support rack may be provided with a bottle opener for removing the screw on safety caps from medicine bottles.

2. Description of the Prior Art

Various types of support racks are known in the prior art. A typical example of such a support rack is to be found in U.S. Pat. No. Des. 69,338, which issued to F. Weigel on Jan. 26, 1926. This patent discloses a support rack having a plurality of spaced hooks and trays for the storage of various manicure items. U.S. Pat. No. Des. 131,311, which issued to A. Sutton on Feb. 3, 1942, discloses a manicure bowl provided with a support tray. U.S. Pat. No. Des. 170,669, which issued to E. Wagner on Oct. 20, 1953, discloses a manicure stand provided with a plurality of spaced recesses for the storage of various manicure articles. U.S. Pat. Des. No. 176,620, which issued to A. Lamarthe on Jan. 10, 1956, discloses a manicure set which provides a plurality of spaced channels for the reception of various manicure utensils. U.S. Pat. No. Des. 240,537, which issued to R. Sronce July 13, 1976, discloses a support tray provided with a plurality of recesses and channels for the storage of various dental equipment and supplies. U.S. Pat. No. Des. 251,512, which issued to L. Freeman on Apr. 3, 1979, discloses a manicure tray provided with storage space for a variety of manicure items.

While the above mentioned devices are suited for their intended usage, none of these devices provide a tweezer support rack having a pair of tweezers retained by a stretchable telephone type cord. Additionally, none of the aforesaid patents disclose a tweezer support rack provided with a bottle opener for removing the screw on safety caps from medicine bottles. An additional feature of the present invention, not disclosed by the previously described prior art devices, is the provision of a tweezer support rack for removably retaining tweezers in a readily accessible location on a bathroom wall. Inasmuch as the art is relatively crowded with respect to these various types of support racks, it can be appreciated that there is a continuing need for and interest in improvements to such support racks, and in this respect, the present invention addresses this need and interest.

SUMMARY OF THE INVENTION

In view of the foregoing disadvantages inherent in the known types of support racks now present in the prior art, the present invention provides an improved support rack for tweezers. As such, the general purpose of the present invention, which will be described subsequently in greater detail, is to provide a new and improved support rack for tweezers which has all the advantages of the prior art support racks and none of the disadvantages.

To attain this, representative embodiments of the concepts of the present invention are illustrated in the drawings and make use of a circular mounting plate provided with an adhesive backing strip for attaching the mounting plate to a bathroom wall. A pair of parallel spaced elongated bars are centrally disposed on a front surface of the mounting plate. The elongated bars form a channel in which a pair of tweezers are removably retained. A coiled plastic telephone type cord has one end attached to one of the elongated bars and an opposite end attached to the tweezers. The tweezers are thus always readily available for removing the cotton packing from medicine bottles. In a second embodiment of the present invention, a bottle opener for medicine bottles is attached to the tweezer mounting plate. The bottle opener forms a shelf on which a medicine bottle may be stored. Thus, the cotton packing from the medicine bottle may be removed by the tweezers after the cap has been removed using the bottle opener.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Pat. and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved support rack for tweezers which has all the advantages of the prior art support racks and none of the disadvantages.

It is another object of the present invention to provide a new and improved support rack for tweezers which may be easily and efficiently manufactured and marketed.

It is a further object of the present invention to provide a new and improved support rack for tweezers which is of a durable and reliable construction.

An even further object of the present invention is to provide a new and improved support rack for tweezers which is susceptible of a low cost of manufacture with regard to both materials and labor, and which accordingly is then susceptible of low prices of sale to the consuming public, thereby making such support racks for tweezers economically available to the buying public.

Still yet another object of the present invention is to provide a new and improved support rack for tweezers which provides in the apparatuses and methods of the prior art some of the advantages thereof, while simultaneously overcoming some of the disadvantages normally associated therewith.

Still another object of the present invention is to provide a new and improved support rack for tweezers which utilizes a mounting plate having an adhesive backing for retaining the tweezers in a readily accessible location on a bathroom wall for removing the cotton packing from medicine bottles.

Yet another object of the present invention is to provide a new and improved support rack for tweezers in combination with a bottle opener for removing the screw on safety caps from medicine bottles.

Even still another object of the present invention is to provide a new and improved support rack for tweezers which utilizes a stretchable plastic telephone type cord for retaining a pair of tweezers in a readily accessible location and allowing the tweezers to be utilized for removing the cotton packing from medicine bottles.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
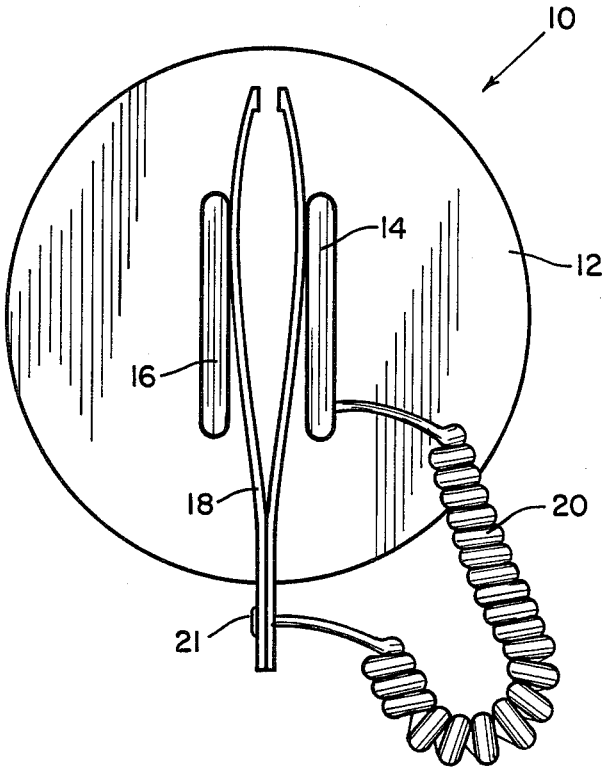
FIG. 1 is a front view of a support rack for tweezers according to a first embodiment of the present invention.

With reference now to the drawings, and in particular to FIG. 1 thereof, a new and improved support rack for tweezers embodying the principles and concepts of the present invention and generally designated by the reference numeral 10 will be described.

More specifically, it will be noted that the first embodiment 10 of the invention includes a circular mounting plate 12 on which a pair of elongated bars 14 and 16 are centrally disposed. The bars 14 and 16 extend outwardly, transverse to the plane of the front surface of the mounting plate 12, and form a channel in which a pair of tweezers 18 are removably retained. A stretchable plastic telephone type cord 20 has one end attached to the bar 14, and an opposite end attached at 21 to the tweezers 18. The cord 20 may be attached to the tweezers 18 by inserting the end of the cord 20 through a hole provided in a handle portion of the tweezers 18 and then heat forming an enlargement 21 on the end of the cord 20. This enlarged head 21 prevents the cord 20 from being pulled back through the hole in the handle portion of the tweezers 18.

Figure 2:
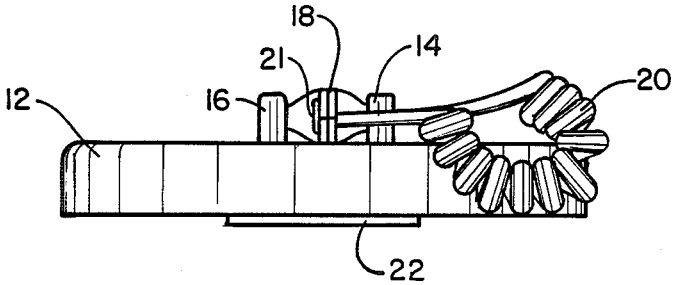
FIG. 2 is an end view of the tweezer support rack of the first embodiment of the present invention.

As shown in FIG. 2, an adhesive backing strip 22 is provided on a back surface of the mounting plate 12. The adhesive backing strip 22 may be of the type having a removable peel strip which is removed immediately prior to positioning the mounting plate 12 at a desired location on a bathroom wall. By use of the tweezer support rack 10 of the first embodiment of the present invention, the tweezers 18 will always be readily accessible for use in removing the cotton packing from medicine bottles.

Figure 3:
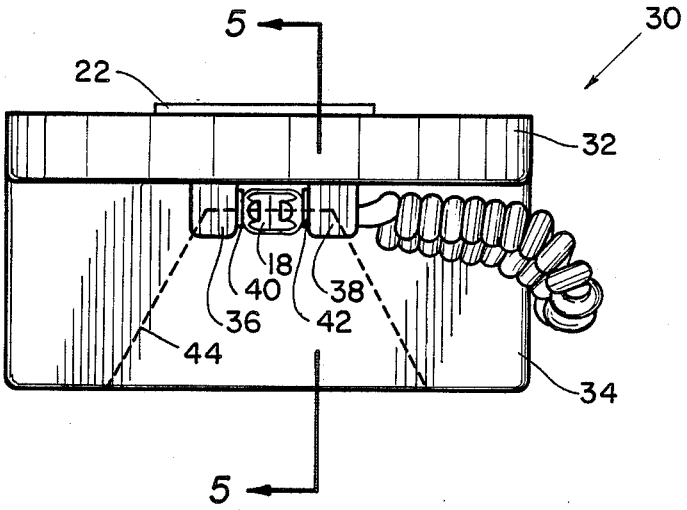
FIG. 3 is a top view of a tweezer support rack according to a second embodiment of the present invention.

In FIG. 3, a tweezer support rack 30 according to a second embodiment of the present invention is illustrated. The tweezer support rack 30 comprises a mounting plate 32 having a transversely extending shelf 34 attached adjacent a bottom edge of the mounting plate 32. An adhesive backing strip 22 is provided on a back surface of the mounting plate 32. A trapezoidal recess 44 is formed in a bottom surface of the shelf 34. The trapezoidal recess serves as a bottle opener for removing the screw on safety caps of medicine bottles. The upper surface of the shelf 34 may be utilized for storage of medicine bottles.

Figure 4:
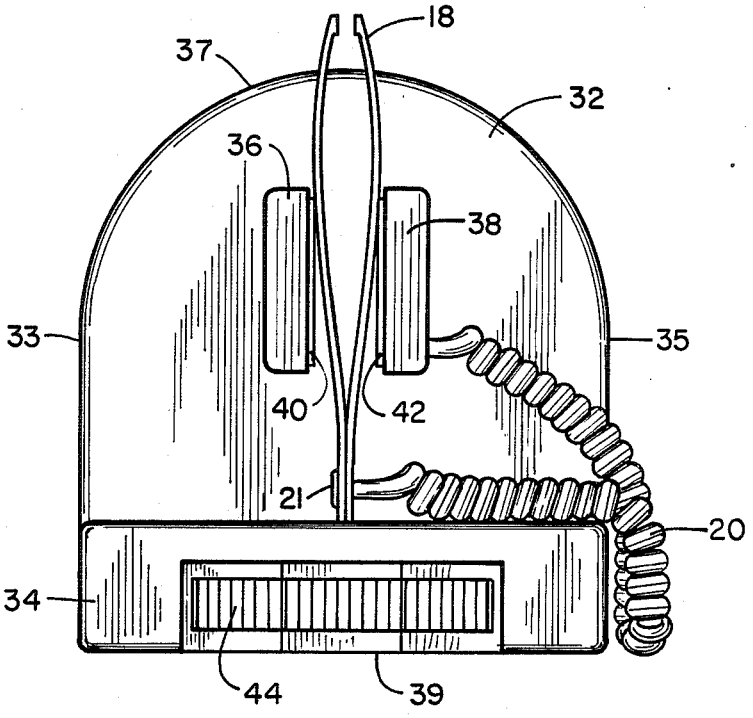
FIG. 4 is a front view of a tweezer support rack according to the second embodiment of the present invention.

With reference now to FIG. 4, it may be seen that a pair of spaced elongated parallel bars 36 and 38 are centrally disposed on a front face of the mounting plate 32. A magnet 40 and 42 is provided on an inner side wall of each of the bars 36 and 38. The magnets 40 and 42 face a channel formed by the bars 36 and 38 and serve to removably retain a pair of metal tweezers 18. The tweezers 18 may alternatively be formed from plastic and the magnets 40 and 42 omitted. The mounting plate 32 has a pair of spaced parallel side walls 33 and 35 connected at one end by a radiused end wall 37 and at an opposite end by a straight end wall 39. The shelf 34 extends perpendicularly to the mounting plate 32, and is attached adjacent the end wall 39. The trapezoidal recess 44 is lined with a serrated rubber strip for engagement with the safety cap of a medicine bottle.

Figure 5:
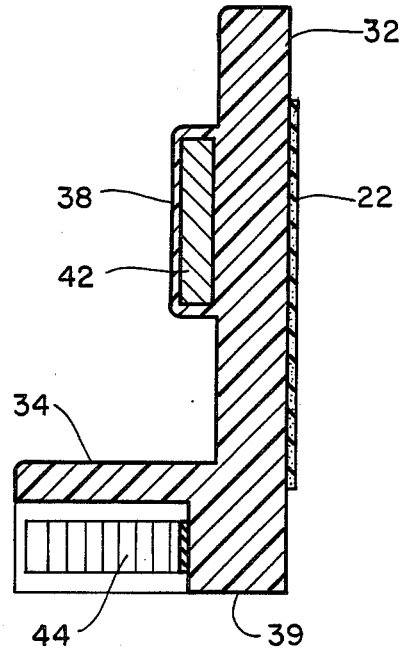
FIG. 5 is a cross sectional view, taken along line 5—5 of FIG. 3, of the tweezer support rack of the second embodiment of the present invention.

In FIG. 5, a cross sectional view, taken along line 5—5 of FIG. 3, is provided which illustrates the recess 44 provided in the transverse shelf 34. The magnet 42 is also illustrated, recessed within the elongated bar 38.

Figure 6:
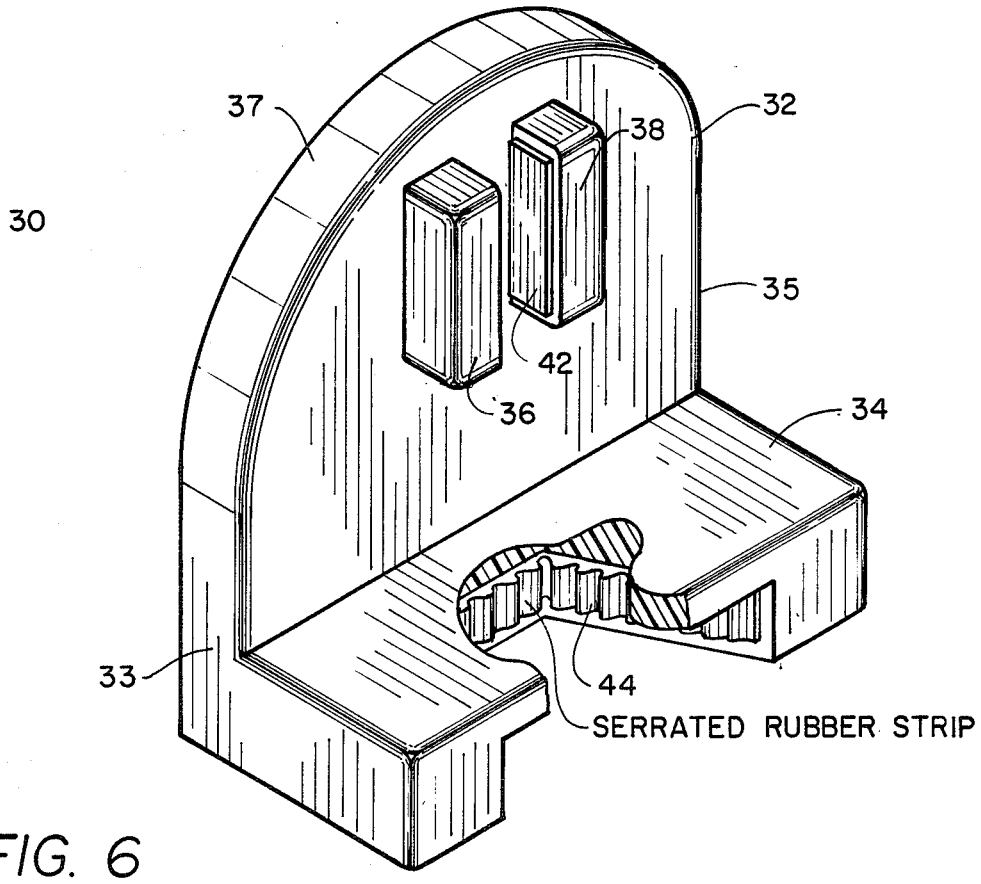
FIG. 6 is a perspective view, partially cut away, illustrating the tweezer support rack according to the second embodiment of the present invention.

With reference now to the perspective view of FIG. 6, the manner of usage of the bottle opener recess 44 will now be described. Due to the converging inclined walls of the recess 44, a bottle cap inserted into the recess will be wedged against the serrated rubber strips lining the walls of the recess 44. This wedging engagement of the serrated rubber strips with the cap 44 will secure the safety cap against rotation, while the medicine bottle is turned, thus removing the cap. Through the use of the tweezer support rack 30 of the second embodiment of the present invention, a medicine bottle stored on the top surface of the shelf 34 may be opened utilizing the opening recess 44 and then the cotton packing from the medicine bottle may be removed utilizing the tweezers 18.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A new and improved support rack for tweezers, comprising:

mounting plate means having front and back surfaces;
means on said back surface of said mounting plate means for securing said plate means to a wall;
a pair of spaced elongated bars extending outwardly in parallel relation from said front surface of said plate means;
a pair of tweezers retained between said bars;
cord means having one end secured to said plate means and an opposite end attached to said tweezers and extending shelf having bottle opening means transversely connected to said mounting plate means.

2. The support rack for tweezers of claim 1, wherein said cord means comprises a stretchable plastic telephone type cord.

3. The support rack for tweezers of claim 2, wherein said cord has one end attached to one of said elongated bars.

4. The support rack for tweezers of claim 3, wherein an opposite end of said cord extends through a hole in a handle portion of said tweezers and an enlarged head is formed on the end of the cord for securing the cord to the tweezers.

5. The support rack for tweezers of claim 1, wherein said means for securing said mounting plate means to a wall comprises an adhesive backing strip.

6. The support rack for tweezers of claim 1, further comprising a magnet on an inner side wall of each of said elongated bars.

7. The support rack for tweezers of claim 1, wherein said bottle opening means comprising a trapezoidal recess formed in a bottom surface of said shelf, side walls of said recess lined with a serrated rubber strip.

8. A new and improved support rack for tweezers, comprising:

a flat mounting plate having front and back surfaces;
said mounting plate having spaced parallel side walls connected at one end by a radiused end wall and at an opposite end by a straight end wall;
an adhesive backing strip on said back surface of said mounting plate;
a pair of spaced parallel elongated bars centrally disposed on said front face of said mounting plate;
said bars extending perpendicularly outwardly from said front mounting plate surface and forming a channel;
a magnet on an inner side wall of each of said bars;
said magnets facing said channel;
a pair of tweezers removably retained in said channel;
a coiled plastic telephone type cord having one end attached to one of said bars and having an opposite end attached to said tweezers;
an outwardly extending shelf attached to said front mounting plate surface adjacent said straight end wall;
a trapezoidal recess formed in a bottom surface of said shelf;
and
said trapezoidal recess having three side walls lined by a serrated rubber strip, whereby said recess may be utilized to open medicine bottles and said tweezers may be utilized to remove cotton packing from the medicine bottle.

* * * * *